United States Patent [19]

Shishido et al.

[11] Patent Number: 4,942,639

[45] Date of Patent: Jul. 24, 1990

[54] BULKY DUST SWEEPER

[75] Inventors: Osamu Shishido; Satoru Noguchi; Seiji Seino, all of Shizuoka, Japan

[73] Assignee: Amano Corporation, Yokohama, Japan

[21] Appl. No.: 262,024

[22] Filed: Oct. 25, 1988

[30] Foreign Application Priority Data

Oct. 27, 1987 [JP] Japan ..... 62-270800

[51] Int. Cl.[5] ..... E01H 1/04

[52] U.S. Cl. ..... 15/83; 15/49·C

[58] Field of Search ..... 15/83, 49 C, 340.1, 15/340.2, 340.3, 340.4, 349; 56/364

[56] References Cited

U.S. PATENT DOCUMENTS

| | | | |
|---|---|---|---|
| 3,006,021 | 10/1961 | Patch | 15/83 X |
| 3,676,886 | 7/1972 | Aiuppa | 15/83 |
| 3,837,157 | 9/1974 | Van Der Lely | 15/83 X |
| 3,849,824 | 11/1974 | Doering | 15/83 |
| 3,859,685 | 1/1975 | Doering et al. | 15/83 |
| 3,999,316 | 12/1976 | Palmer | 15/83 X |
| 4,457,044 | 7/1984 | Erdman et al. | 15/83 |
| 4,459,719 | 7/1984 | Notestine | 15/83 |

*Primary Examiner*—Edward L. Roberts

*Attorney, Agent, or Firm*—Wenderoth, Lind & Ponack

[57] ABSTRACT

A bulky dust sweeper has side brushes for brushing and gathering bulky dust, and a main brush mounted on a bottom portion of its vehicle body and adapted to sweep the bulky dust into a hopper. The bulky dust sweeper also has a scrape-in device disposed within the hopper for scraping the bulky dust which has been swept into the hopper by the main brush, into a dust connected to the inside of the hopper, a push-in device disposed at an inlet port of the duct and adapted to push the bulky duct, which has been scraped into the duct by the scrape-in device, toward the uppermost end of the duct, and a dust collecting bag removably attached to a top opening of the duct and adapted to collect the dust therein.

2 Claims, 5 Drawing Sheets

BULKY DUST SWEEPER

BACKGROUND OF THE INVENTION

1. Field of the Invention

This invention is used in the technical field of a sweeper for sweeping a street surface, a road surface, a floor surface, etc. More particularly, the present invention relates to a bulky dust sweeper which is especially suitable for sweeping a light-weight and bulky refuse material (hereinafter simply referred to as "bulky dust") such as, for example, fallen leaves, dead leaves, paper and the like.

2. Brief Description of the Prior Art

As tools for automatically cleaning or sweeping bulky dust scattered in the street, road, parks, factories, etc., there have been known and used sweepers, vacuum cleaners or the like.

The conventional sweepers comprise side brushes for gathering bulky dust together and a main brush mounted on a bottom portion of a vehicle body and adapted to sweep such gathered bulky dust into a hopper. On the other hand, the conventional vacuum cleaner comprises a sucking port and a blower for acting on the sucking port in order to suck bulky dust therein.

However, the conventional sweepers have the disadvantage that the hopper is soon filled with dust of comparatively light-weight specific gravity and bulky size. Therefore, the dust collected in the hopper must be removed frequently. Moreover, the conventional sweeper is incapable of sweeping a large quantity of dust at one time because the dust of comparatively light-weight specific gravity readily overflows out of the inlet port of the hopper and remains there as dust not swept. In order to sweep and clean such overflowed dust, it is necessary to perform the sweeping operation repeatedly. This is troublesome indeed. In addition, the secondary processing and the secondary transportation of the bulky dust, which had been removed from the hopper, are very troublesome too because the dust as a whole is bulky.

The method for vacuuming up bulky dust using a conventional vacuum cleaner also has various kinds of problems chiefly because the material is bulky dust as in the case using a conventional sweeper and therefore, is incapable of treating a large quantity of dust at one time. Particularly, in the event the dust is wet and stuck to a street surface, a floor surface, etc., it is impossible to vacuum up such dust complete with a vacuum cleaner because there always remain dust not swept. This method is incapable of sweeping bulky dust efficiently and in a proper manner, and is basically inferior to the conventional sweeper.

The present invention has been accomplished in order to overcome the above-mentioned problems inherent in the prior art.

SUMMARY OF THE INVENTION

It is therefore an object of the present invention to provide a bulky dust sweeper which is capable of sweeping a large quantity of dust at one time.

Another object of the present invention is to provide a bulky dust sweeper which is capable of sweeping dust in such a manner as that a secondary processing and a secondary transporation of the dust can be performed in a comparatively easy way.

A further object of the present invention is to provide a sweeper for bulky dust, in which dust does not overflow out of the inlet port of its hopper.

In order to achieve the above objects, a bulky dust sweeper according to the present invention comprises (1) scrape-in means disposed within a hopper which is mounted on a bottom portion of a vehicle body and adapted to scrape bulky dust, which is brushed into the hopper by a main brush, into a duct connected to inside the hopper;

(2) push-ins means disposed at an inlet port of the duct and adapted to push the bulky dust, which is scraped into the hopper by the scrape-in means, toward the uppermost end of the duct; and (3) a dust collecting bag removably attached to a top opening of the duct and adapted to collect the dust therein.

The scrape-in means includes a rotary vane which is rotated by a motor. The push-in means includes a push-in flap which is reciprocally operated by a cylinder.

The functions of the above-described means (1) through (3) are as follows.

By the scrape-in means of the above item (1), the bulky dust, which has been swept or brushed into the hopper by the main brush, is successively sent into the duct connected to the hopper without being allowed to stay within the hopper nor overflow out of an inlet port of the hopper and even such dust as fallen leaves, which are wet and stuck to a street surface, a floor surface, etc., are all completely swept into the hopper and no dust remains not swept.

By the push-in means (2), since the bulky dust, which has been scraped or swept into the hopper by the scrape-in means, is pushed in toward the uppermost end (inner side) of the duct by the push-in means, the bulky dust is compressed to the smallest possible size by the push-in means. Therefore, a much larger quantity of dust can be collected at one time compared with the conventional sweeper, wherein bulky dust is swept in its original form. Accordingly, even bulky dust can be swept efficiently.

By the collecting means (3), since the bulky dust, which is successively pushed in toward the uppermost end of the duct by the push-in means while being compressed, is directly pushed into the dust collecting bag which is attached to the top opening of the duct, the bulky dust contained in the bag can be efficiently subjected to a secondary processing and a secondary transportation because it is contained in the dust collecting bag.

The above objects and still further objects and features of the present invention will immediately become apparent to those skilled in the art after consideration of the following preferred embodiments of the invention which are described by way of example and not by way of limitation wherein:

DETAILED DESCRIPTION OF THE PREFERRED EMBODIMENT

One preferred embodiment of a bulky dust sweeper according to the present invention will be described in detail with reference to the accompanying drawings.

Figure 1:
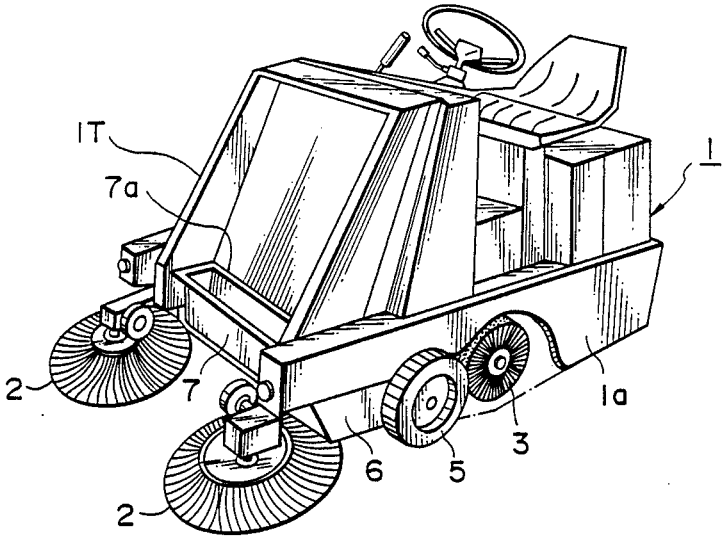
FIG. 1 is a perspective view of a bulky dust sweeper according to one preferred embodiment of the present invention.
Figure 2:
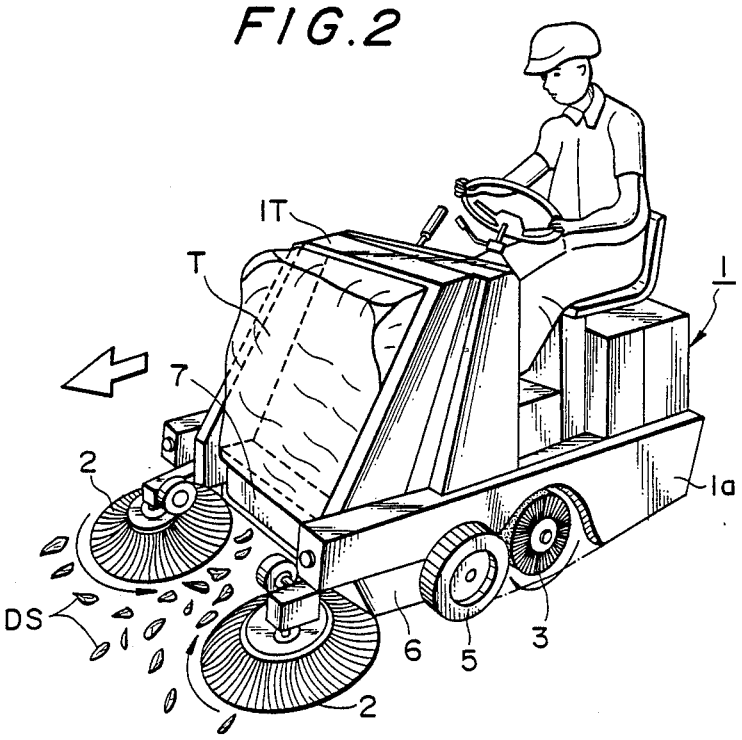
FIG. 2 is likewise a perspective view thereof but showing the sweeper in operation.

In FIGS. 1 and 2, reference numeral 1 generally denotes a sweeper according to the present invention. The illustrated sweeper 1 is of the self propelled type with a driver sitting on its seat. However, it may be a self-propelled type with a driver operating the sweeper while walking on foot. In other words, the type of a sweeper may be selected according to necessity.

Reference numerals 2 denote side brushes each disposed at the front part of each side of a vehicle body 1*a*. These brushes 2 are rotated inwardly in order to sweep and gather bulky dust DS toward the front center of the vehicle body 1*a*. On the other hand, 3 denotes a main brush which is mounted across the bottom portion of the vehicle body 1*a*. In the illustrated embodiment, the main brush 3 is rotated clockwise as shown by an arrow in FIGS. 2 through 4 in order to sweep the bulky dust DS into a hopper 4 which is likewise mounted on the bottom portion of the vehicle body 1*a*. 5 denotes a drive wheel for driving the sweeper 1.

Reference numeral 6 denotes a casing mounted on the bottom portion of the vehicle body 1*a*. The casing 6 is provided with an inlet opening 6*a*. The opening 6*a* has at its inner side the hopper 4. The hopper 4 is connected at its inner end with a duct 7 which is bent in a generally L-shape. The duct 7 is open at its top as denoted by 7*a*. Over the top opening 7*a* is removably attached a dust collecting bag T for containing compressed bulky dust therein. In FIGS. 1 and 2, 1T denotes a protecting frame mounted on the front surface of the vehicle body 1*a*. The dust collecting bag T is expanded within the protecting frame 1T when the bulky dust DS is pushed therein.

Figure 3:
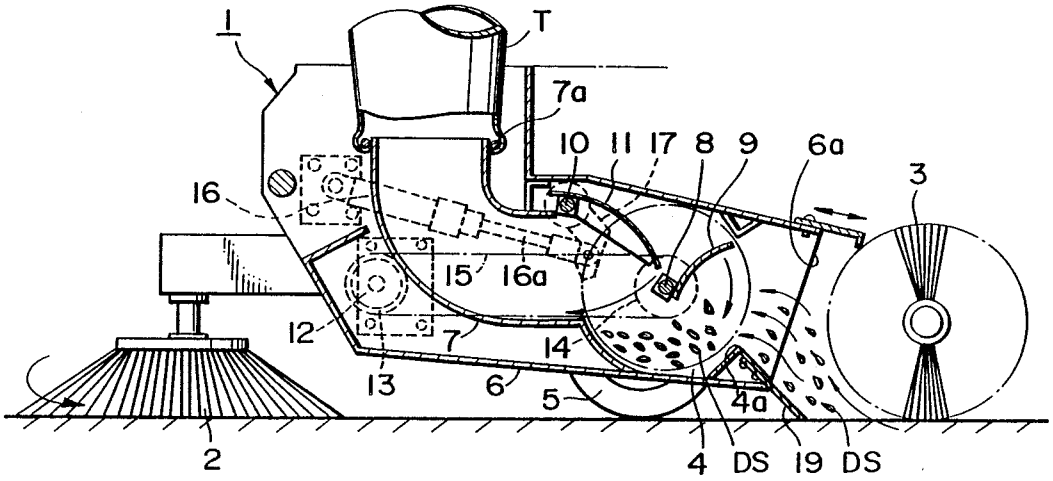
FIG. 3 is a side sectional view showing the internal structure of an important part thereof.
Figure 4:
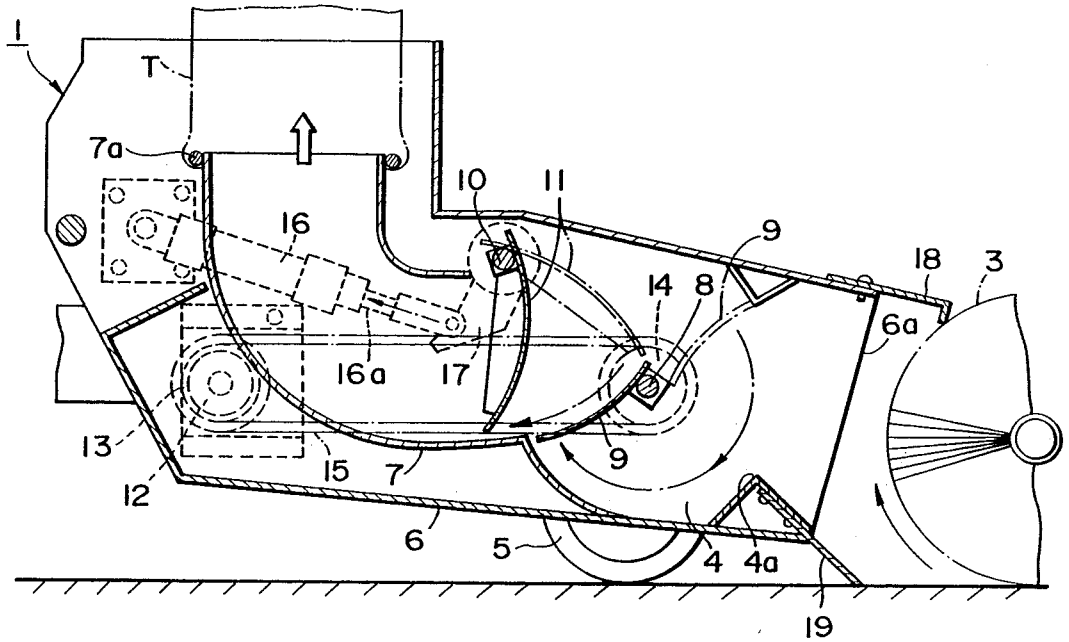
FIG. 4 is an enlarged side sectional view similar to FIG. 3 showing the operating states of a rotary vane and a push-in flap.

In FIGS. 3 and 4, reference numeral 8 denotes a rotating shaft which is disposed across the central portion of the hopper 4. The rotating shaft 8 is provided with a rotating vane 9 for scraping the bulky dust DS, which has been swept into the hopper 4, into the duct 7 connected to the inner end of the hopper 4. Reference numeral 10 denotes an operating shaft 10 disposed at an inlet port end of the duct 7. The operating shaft 10 is provided with a flap for pushing the bulky dust DS, which has been scraped into the hopper 4 by the rotating vane 9, toward the uppermost end (inner end) of the duct 7.

Figure 5:
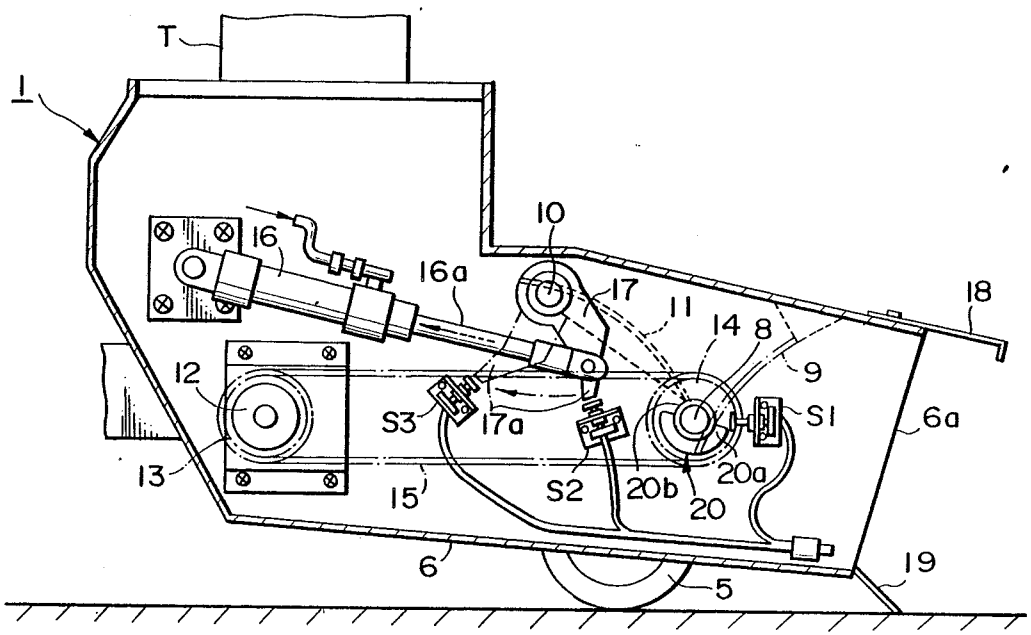
FIG. 5 is a side view similar to FIG. 3 showing the operation mechanism of the rotary vane and push-in flap.

In FIGS. 3 through 5, reference numberal 12 denotes a hydraulic motor mounted on the outer surface of the casing 6. The motor 12 is provided on a rotating shaft thereof with a drive sprocket 13. Between the drive sprocket 13 and a sprocket 14 mounted on the rotating shaft 8 of the rotating vane 9, is provided an endless chain 15 so as to transmit the rotation of the motor 12 to the rotating vane 9. On the other hand, reference numeral 16 denotes a hydraulic cylinder likewise mounted on the outer surface of the casing 6. A leading end of a cylinder rod 16*a* of the cylinder 16 is connected to a swinging arm 17 secured to the operating shaft 10 of the push-in flap 11 so as to transmit the expanding/contracting motion of the cylinder rod 16*a* to the push-in flap 11 to reciprocally move the push-in flap 11. In the figures, reference numeral 18 denotes a baffle plate which is movably mounted over the inlet opening 6*a* of the casing 6 and which is adapted to greatly reduce the space between the main brush 3 and the hopper 4, 4*a* denotes a projection mounted just inside the inlet opening 6*a* on the bottom portion of the hopper 4*a* and adapted to prevent the overflow of the bulky dust DS, and 19 denotes a ground engaging plate which is made of a rubber material.

In FIG. 5, reference numeral 20 denotes a metal cam mounted on the rotating shaft 8 of the rotating vane 9. One half of the periphery of the metal cam 20 has a projecting cam portion 20*a*, whereas the remaining half part has a recess portion 20*b*. S1 denotes a first sensor disposed proximate to the metal cam 20. When the sensor S1 detects the projecting cam portion 20*a* of the metal cam 20, a switch is turned on.

On the other hand, S2 denotes a second sensor and S3 denotes a third sensor. The second and third sensors S2 and S3 are adapted to detect the start/end position of the push-in flap 11. The second and third sensors S2 and S3 respectively are placed at the start and end positions corresponding to a foremost end portion 17*a* of the swinging arm 17 which is mounted on the operating shaft 10 of the flap 11.

Figure 6:
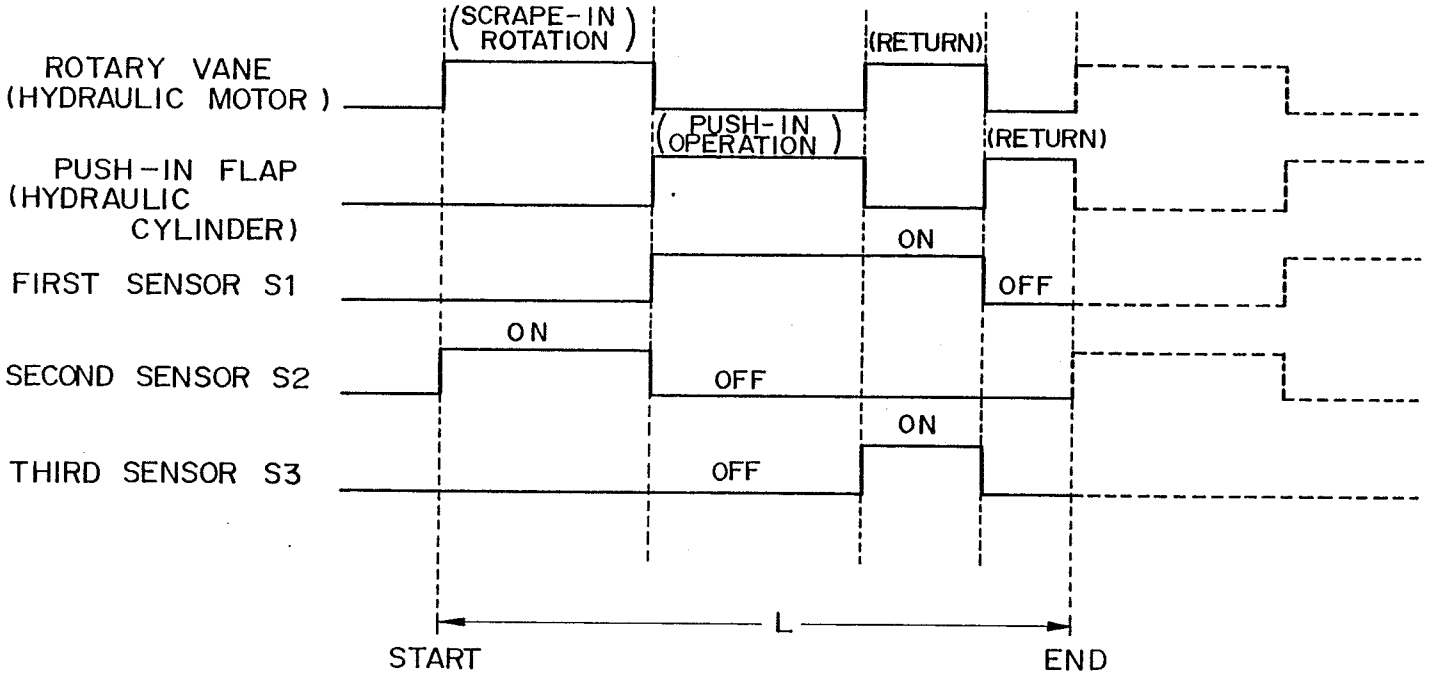
FIG. 6 is a timing chart of the operation thereof.

FIG. 6 is an operation timing chart showing the relation amont the rotating vane 9 and the push-in flap 11, and the sensors S1 through S3. When the rotating vane 9 is rotated from the start position to the scrape-in position of FIG. 3 by about a half-rotation and stopped after scraping the bulky dust DS from the hopper 4 into the duct 7, the push-in flap 11 is rotated down to the position of FIG. 4 from the position of FIG. 3 and pushes the bulky dust DS, which has been scraped into the inlet end of the duct 7 by the scrape-in flap 11, toward the inside of the duct 7 to compress the bulky dust DS. When the push-in flap 11 is stopped after completion of the push-in operation, the rotating vane 9 performs the remaining half rotation toward the start position and then stops. Thereafter, the push-in flap 11, which has finished the push-in operation, is moved back to the start position to complete one cycle operation. It is designed such that the rotating vane 9 and the push-in flap 11 are not engaged with each other during the operation.

According to a control device which includes the sensors S1 through S3, when the cleaning or sweeping operation is started in the fashion as shown in FIG. 5, the motor 12 is actuated by the detecting signal ON of the second sensor S2 and the rotating vane 9 starts its scrape-in operation. When the rotating vane 9 is rotated by about a half rotation and when the first sensor S1 detects the cam portion 20*a* of the metal cam 20, the motor 21 is stopped and the scrape-in operation of the rotating vane 9 is finished.

When the first sensor S1 is turned on by the cam portion 20*a*, the cylinder 16 of the push-in flap 11 starts actuation according to the ON-signal and at the same time, the second sensor S2 is turned off.

The actuation of the push-in flap 1 is continued by the operation of the cylinder 16 until the third sensor S3 is turned on by the foremost end portion 17*a* of the swinging arm 17. As soon as the operation of the cylinder 16 is stopped due to the actuation of the third sensor S3, the stopped motor 12 is actuated to return the rotating vane toward the start position, whereas the first sensor S1 maintains the rotation of the motor 12 until it senses the cam portion 20*a*.

The return rotation of the rotating vane caused 9 by the motor 12 is stopped when the first sensor S1 is turned off upon sensing the cam portion 20*a* of the metal cam 20. Then the cylinder 16 is actuated by the off-signal to return the push-in flap 11 and the second sensor S2 is turned on by the foremost end portion 17*a* of the rotating vane 17, operation of the cylinder 16 is stopped and one-cycle of operation is over. Then, the above-mentioned procedure is repeated all over again and again. The time L required for the one-cycle of operation is seven seconds. The length of the required time L can of course be adjusted by adjusting the oil pressure which is fed to the motor 12 and cylinder 16.

Since a sweeper for bulky dust according to the present invention has the above-described construction, when the sweeper 1 is operated, the side brushes 2 start to sweep the bulky dust DS toward the center. The bulky dust DS, which has been swept toward the center, is then successively brushed into the hopper 4 by the main brush 3. The bulky dust DS, which has been brushed into the hopper 4, is then successively swept toward the inlet port of the duct 7 by the rotating vane 9 which is rotated intermittently. The bulky dust DS, which has been scraped into the inlet port of the duct 7, is then succesively pushed further into the duct 7 by the push-in flap 11 and compressed and then pushed into the dust collecting bag T which is attached to the uppermost opening 7*a* of the duct 7.

As apparent from the above description, according to a sweeper for bulky dust of the present invention, dust such as fallen leaves, paper, etc., which are comparatively light in gravity and bulky in size, can be collected in the compressed state by the scrape-in and push-in operation. Therefore, a large quantity of dust can be collected at one time and thus the sweeper is very convenient. Moreover, bulky dust, which has been once swept into the hopper, does not overflow and come back out of the inlet port of the hopper. Therefore, the street surface, the floor surface, etc. can be completely cleaned with this sweeper without leaving dust not swept. Furthermore, since the bulky dust, which has been collected, can all be put into a dust collecting bag, it has such advantage as that secondary processing and secondary transportation can be facilitated. Thus, a sweeper for bulky dust according to the present invention is a most suitable instrument when used for sweeping a place such as a park, street, factory, etc. where bulky dust is present.

Although the present invention has been described in respect to a specific preferred embodiment thereof, many variations and modifications thereof will immediately become apparent to those skilled in the art. It is therefore the intention that the appended claims be interpreted as broadly as possible in view of the prior art to include all such variations and modifications.

What is claimed is:

1. A bulky dust sweeper comprising:

a vehicle body having side brushes at a forward end of the vehicle body for brushing up bulky dust toward the center of the vehicle body, and a main brush mounted on the bottom of said vehicle body for sweeping up the bulky dust which has been brushed toward the center of the vehicle body by said side brushes;

a hopper on said vehicle body adjacent said main brush and positioned to receive bulky dust swept up by said main brush through a front end of said hopper;

a duct having one end connected to said hopper;

a scraper vane rotatably disposed in said hopper and drive means for rotating said scraper vane for scraping the bulky dust which has been brushed into the hopper by said main brush to the position where said duct is connected to said hopper;

a push-in flap disposed in said sweeper where said duct is connected to said hopper and reciprocal drive means connected to said push-in flap for reciprocatingly moving said push-in flap for pushing the bulky dust which has been scraped to the position where said duct is connected to said hopper by said scraper vane into and toward the other end of said duct; and a dust collecting bag removably attached to the other end of said duct for receiving and collecting therein the dust pushed through said duct by said push-in flap.

2. A bulky dust sweeper as claimed in claim 1 further comprising control means connected to said drive means and said reciprocal drive means for causing said rotating vane to be temporarily stopped after it has rotated about a half rotation for completing a scrap-in operation, for then causing said push-in flap to perform motion in a direction toward said duct and then stopping, then causing said rotating vane to complete a full rotation to return to a starting position, and then causing said push-in flap to perform reciprocal motion back toward a starting position.

* * * * *